United States Patent [19]

Freisler

[11] 4,112,981

[45] Sep. 12, 1978

[54] DEVICE FOR FEEDING PILE WARP YARNS FOR PILE FABRIC LOOMS

[75] Inventor: Erhard Freisler, Bubikon, Switzerland

[73] Assignee: Ruti Machinery Works Ltd., Ruti, Switzerland

[21] Appl. No.: 750,874

[22] Filed: Dec. 15, 1976

[30] Foreign Application Priority Data

Jan. 20, 1976 [CH] Switzerland ..... 623/76

[51] Int. Cl.[2] ..... D03C 49/06; D03D 39/22

[52] U.S. Cl. ..... 139/102; 139/25

[58] Field of Search ..... 139/102, 97, 103, 25–27

[56] References Cited

U.S. PATENT DOCUMENTS

| | | | |
|---|---|---|---|
| 392,284 | 11/1888 | Ott | 139/102 |
| 1,249,899 | 12/1917 | Carpenter | 139/25 |
| 1,322,671 | 11/1919 | Davis | 139/25 |
| 3,889,719 | 6/1975 | Seifert | 139/25 |

FOREIGN PATENT DOCUMENTS

| | | | |
|---|---|---|---|
| 492,051 | 7/1970 | Switzerland | 139/102 |

*Primary Examiner*—James Kee Chi

*Attorney, Agent, or Firm*—Donald D. Denton

[57] ABSTRACT

Device for pile fabric looms for feeding pile warp yarns, having a warp beam, a feed roller for removing the pile warp yarns from the pile warp beam, and a guide roller for the pile warp yarns arranged between the pile warp beam and the shed-forming mechanism.

4 Claims, 2 Drawing Figures

DEVICE FOR FEEDING PILE WARP YARNS FOR PILE FABRIC LOOMS

BACKGROUND OF THE INVENTION

The present invention relates to a device for feeding pile warp yarns for pile fabric looms, having a pile warp beam, a feed roller for removing the pile warp yarns from the pile warp beam, and a guide roller for the pile warp yarns arranged between the pile warp beam and the shed-forming mechanism of the loom.

In known arrangements of this type, the pile warp yarns pass from the pile warp beam over one or more feed rollers and one or more guide rollers, arranged, in the direction of transport of the pile warp yarns, behind the feed rollers to the shed-forming mechanism. The guide rollers are arranged below the feed rollers and spaced from them. In case of a break in the warp yarns, the operator must reach in the region between the feed and guide rollers and between the pile warp yarns in order to be able to correct the break in the yarn. This reaching through the pile warp yarns necessarily results in a lateral displacement of the warp yarns. This lateral displacement in its turn effects an increase in the tension of the pile warp yarns concerned. As a result of the increased tension in the warp yarns, the loops are thereby drawn back in whole or in part. This results in a weaving defect which can scarcely be eliminated.

One of the objects of the present invention is to provide a device or an arrangement for the feeding of the pile warp yarns in which said disadvantage is avoided by the simplest possible means. The closest prior art known to applicant in connection with this application is Swiss Patent No. 492,051.

SUMMARY OF THE INVENTION

The device in accordance with the invention is characterized by the fact that a feed roller is provided that performs a dual function, that is, it serves at the same time as guide roller and is in addition arranged directly before the point of entry of the pile warp yarns into the shed.

In the arrangement of the device of this invention, the pile warp yarns extend from the pile warp beam over the combined feed and guide roller to the shed of the loom. Reaching through the pile of warp yarns in order to eliminate a break in the warp yarn is effected in the region between the pile warp beam and the combined feed and guide roller. Since the space between the pile warp beam and the combined feed and guide roller is relatively large, there is substantially better accessibility of the warp yarns for the elimination of yarn breaks with the arrangement of the invention than with the known arrangements.

Furthermore, upon reaching through the pile warp yarns the warp yarns are not pulled back, there being rather an additional pull-off from the pile warp beam which has no effect on the quality of the weaving because the feed roller, which by definition is capable of withdrawing the pile warp yarns from the pile warp beam and thus has a construction and/or nature suitable for the carrying along of the pile warp yarns, opposes sufficiently great resistance to the corresponding pull on the warp yarns upon the reaching through them. Therefore, with the device of this invention the undesired pulling back of the loops is avoided, thus providing an improvement in the quality of the woven product.

Another advantage of the device in accordance with the invention is that at least one guide roller is eliminated, as compared with traditional arrangements, by the combined feed and guide roller thus making the device less complicated.

Furthermore, the tension of the warp yarn between the warp yarn beam and the feed roller can be made different than the tension between the feed roller and the shed, which latter warp yarn tension must be adjustable in accordance with the specific article being woven. Thus a first or former warp yarn tension can be provided that is adapted to an optimum pulling-off of the pile warp yarns and, independently thereof, a second or latter warp yarn tension can be adapted to the article being woven.

BRIEF DESCRIPTION OF THE DRAWINGS

The invention will be described in further detail below on basis of an illustrative embodiment thereof, in which.

DESCRIPTION OF PREFERRED EMBODIMENT

Figure 1:
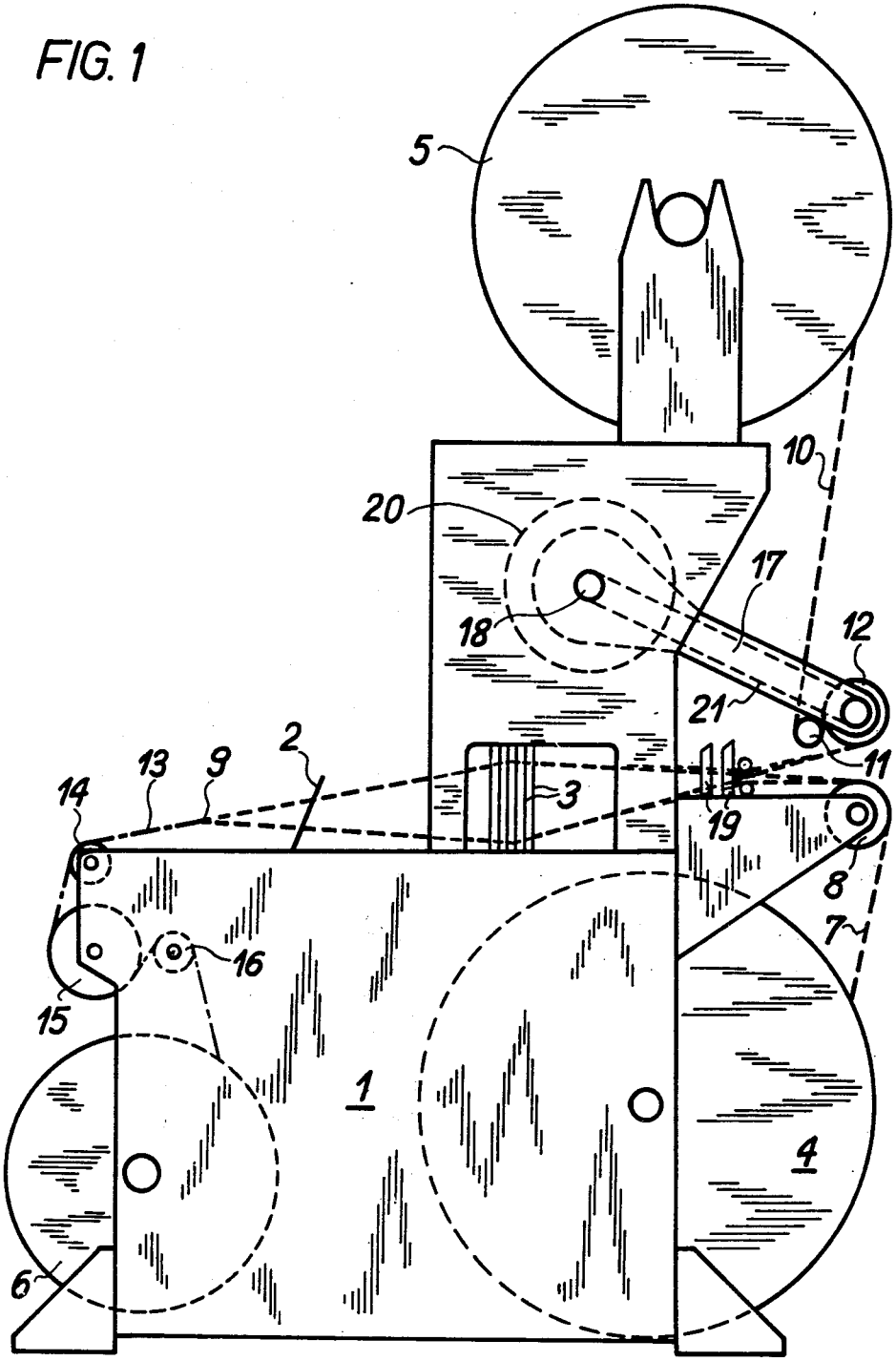
FIG. 1 is a side view of a loom provided with the device in accordance with the invention for the feeding of the pile warp yarns.

A loom for weaving pile fabrics is partially illustrated in FIG. 1 showing a loom frame 1, a reed 2 fastened to a batten, shed-forming heddles 3, a ground-warp beam 4, a pile-warp beam 5 and a fabric beam 6. The ground-warp yarns 7 travel from the ground-warp beam 4 over a whip roll 8 to the shed-forming heddles 3 and from there to the fell 9 of the cloth. Pile-warp yarns 10 travel from pile-warp beam 5 over tensioning roller 11 and feed roller 12 to the shed-forming heddles 3 and the fell 9. Between the shed-forming heddles 3 and the whip or feed roll 8 or 12, respectively, warp stop motion devices 19 are provided. The fabric 13 moving away from the fell 9 of the cloth travels over breast beam 14, draw-off roller 15, and guide roller 16 to the fabric beam 6.

The loom operates in cycles of several, e.g. three, consecutive partial battenings and a following full battening. Upon the partial battenings, the reed 2 does not beat the introduced filling yarn fully against the fell 9 of the cloth, while upon the full battening the filling yarn last inserted is beaten against the fell 9. Thus the pile warp yarns 10 lying between the incompletely beaten-up filling yarns which were subjected to a change of shed between the individual partial battenings are formed into pile loops.

The tension roll 11 and the feed roller 12 are supported at their ends in a common support arm 17. The support arms 17 are in their turn supported on the loom frame 1 and can be swung around their supporting shaft 18 and set at different angular positions. This facilitates the drawing-in of new pile warp yarns since in order to tie the new warp to the old one the support arms 17, together with the tension roll 11 and the feed roller 12, can be swung upward in counterclockwise direction. The tying is effected below the upward-swung tension and feed rollers 11 and 12.

The surface of the feed roller 12 is provided with a surface that has a coefficient of friction which is sufficient for pulling the pile warp yarns 10 from the pile warp beam 5 and for this purpose the surface is provided, for instance, with a covering of rubber, plush, cork, or the like. The feed roller 12 is driven in known manner, as indicated in the figure, by a drive wheel 20 which symbolizes a pile warp let-off mechanism mounted on the frame 1 and a drive means 21 connecting the pile warp let-off mechanism with the feed roller 12. The drive means 21 may, for instance, be a chain or a toothed belt which is in engagement with suitable gears operatively connected with the drive wheel 20 of the pile-warp let-off mechanism and with the feed roller 12. The drive of the feed roller 12 is operatively associated with an adapted to the drive of the take-off roller 15 and thus to the drawing off of the fabric.

As can be noted particularly from FIG. 1, the feed roller 12 also has the function of a guide roller for the pile warp yarns 10. The feed roller 12 is arranged directly in front of the entrance of the pile warp yarns 10 into the shed and is somewhat above the whip roll 8. Since no other guide roller is present, aside from the feed roller 12, at least one guide roller is eliminated and thus saved. This provides a relatively large space free of rolls between the pile warp beam 5 on the one hand and the tension and feed rolls 11 and 12 on the other hand. Upon the occurrence of a break in the warp yarn, one can reach the point of break through the group of pile warp yarns which are tensioned in this space.

Figure 2:
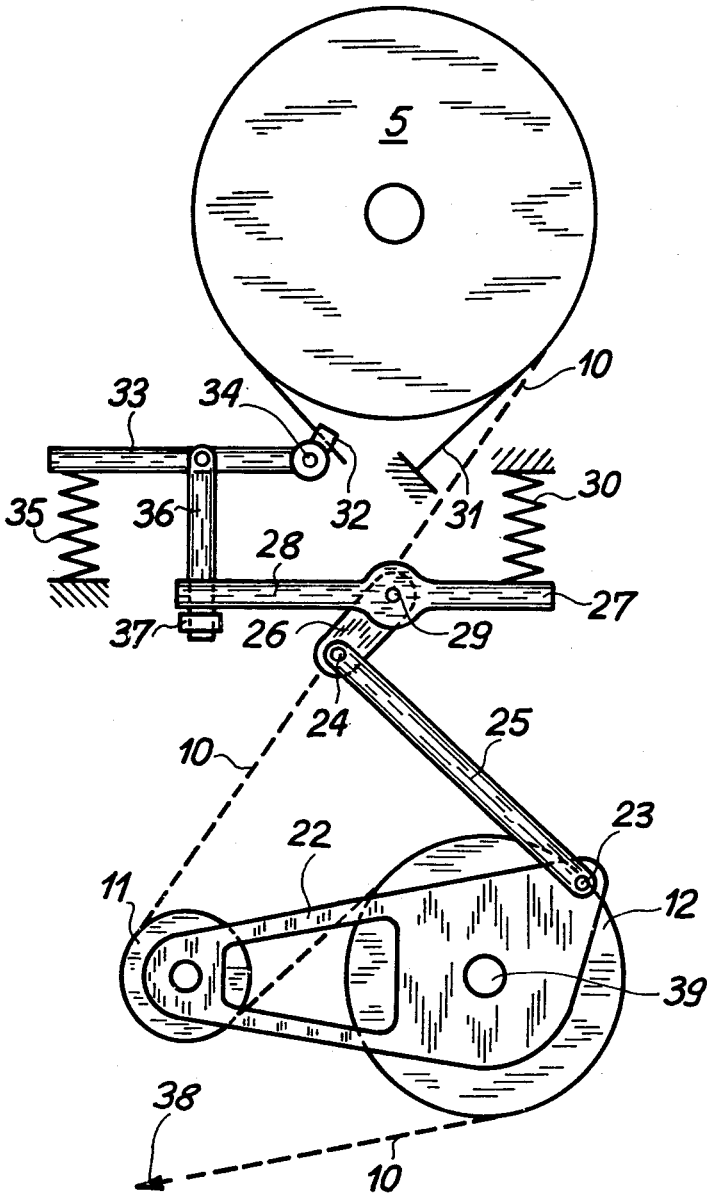
FIG. 2 shows a detail of the device shown in FIG. 1.

In FIG. 2, the pile warp beam 5 and the tension and feed rolls 11 and 12 are shown in greater detail, the manner of attachment of the pile warp beam 5 to the machine frame and the supporting arms 17 as well as the drive means 21 (FIG. 1) not being included in this drawing so as not to clutter it. As can be noted from FIG. 2, the tension roll 11 is supported on each end by a support arm 22 which is swingable around the shaft 39 of the feed roll 12. The supporting arm 22 is connected with an actuating arm 26 by a tie rod 25, which is pivotally supported at its two ends 23 and 24. The actuating arm 26 is rigidly connected with a first double-arm lever 27, 28 and swingable with the latter around a shaft 29. An initial tension is constantly exerted on the lever arm 27 by a first spring 30, the one end of which rests against a fixed part of the frame 1.

A brake 31 is operatively associated with the pile warp beam 5. This brake is fastened at its one end to a fixed part of the frame 1, while its other end is held to the one arm 32 of a second double-armed lever 32, 33. The double-armed lever 32, 33 is swingable about a shaft 34, while its other arm 33 is continuously under the pressure of a second spring 35 whose other end rests against a fixed part of the frame 1. On the lever arm 33 there is mounted a bar 36, which bears a stop 37 at its free end. The arm 28 of the first double-armed lever 27, 28 is displaceably guided on the bar 36 at its end which faces away from the swivel shaft 29 and it can slide back and forth between the stop 37 and the arm 33 of the second double-armed lever 32, 33.

When the loom is in operation, pile warp yarns 10 are continuously required for the weaving process. These yarns are pulled off from the pile warp beam 5 by corresponding rotary movements of the feed roller 12 by means of its drive means 21 and slowly pulled by the take-up roll 15 (FIG. 1) away from the feed roll 12 in the direction indicated by the arrow 38. There is a small need for warp pile yarns 10 for the partial beatings and a relatively large need for the full beatings.

As long as the brake 31 of the pile warp beam 5 is applied, the pile warp beam 5 is stationary. Upon pull on the pile warp yarns 10 as a result of a rotation of the feed roller 12, a force is exerted on the tension roll 11 while the pile warp beam 5 is stationary, as a result of which force the supporting arms 22 are swung in clockwise direction around the shaft 39. This swinging takes place against the pressure of the first spring 30, acting on the supporting arm 22, via the arm 27 of the first double-armed lever 27, 28, the actuating arm 26, and the tie rod 25. Upon the swinging of the supporting arm 22, the arm 28 of the first double-armed lever 27, 28 slides on the bar 36 to the stop 37.

After a given motion of rotation of the feed roller 12, the arm 28 of the first double-armed lever 27, 28 comes against the stop 37 and thus pulls, via the bar 36, against the force of the second spring 35, on the arm of the second double-armed lever 32, 33. Thereby the latter is swung around the shaft 34 and the brake 31 of the pile warp beam 5 is released. The pile warp beam 5 starts to turn in clockwise direction as a result of the pull on the pile warp yarns 10, and pile warp yarns 10 are supplied to the feed roll 12. In this way the force on the tension roll 11 is eliminated and the supporting arms 22 are swung back in counterclockwise direction into their original position via the parts 25, 26, and 27 by the pressure of the first spring 30. Upon this swinging of the supporting arms 22, the first double-armed lever 27, 28 is also swung, in such a manner that its arm 28 slides on the bar 36 in the direction towards the arm 33 of the second double-armed lever 32, 33 and thereby releases the stop 37. In this way, the brake 31 can again be applied by the second spring 35 via the second double-armed lever 32, 33, and the cycle described commences all over again.

The actuating of the brake 31 of the pile warp beam 5 need not necessarily be effected mechanically. It is also possible for electric switches for the opening and closing of the brake 31 to be arranged in the path of swing of the arm 32 of the second double-armed lever 32, 33. These electric switches could also control a special drive for the pile warp beam 5 instead of, or in addition to, the brake 31.

It will be appreciated that various changes and/or modifications may be made within the skill of the art without departing from the spirit and scope of the invention illustrated, described, and claimed herein.

What is claimed is:

1. Device for the feeding of pile warp yarns for looms for weaving pile fabrics, having a pile warp beam, a feed roll, for the pulling of the pile warp yarns from the pile warp beam and guiding the pile warp yarns, arranged between the pile warp beam and a shed-forming mechanism, said feed roll simultaneously serving as guide roll and being arranged directly in front of the place of introduction of the pile warp yarns into the shed-forming mechanism of the loom and being supported by a common support arm which is swingable about a pivot mounted on the loom frame and adjustable to at least two positions of swing.

2. The device according to claim 1 in which a tension roll maintained under initial tension and adapted to tension the pile warp yarns in the region between the pile warp beam and the feed roll is operatively positioned in front of the feed roll.

3. The device according to claim 1 in which the tension roll is swingably supported by the common support arm and a brake means, which is controlled as a function of the position of swing of the tension roll, is operatively associated with the pile warp beam.

4. The device according to claim 1 in which the tension roll is pivotably supported on the common support arm, and a drive means, which is controlled as a function of the position of swing of the tension roll, is operatively associated with the pile warp beam.

* * * * *